US007861752B1

(12) United States Patent
Leaf

(10) Patent No.: US 7,861,752 B1
(45) Date of Patent: Jan. 4, 2011

(54) SAW GUIDE SYSTEM

(76) Inventor: Michael A. Leaf, 1362 Hamilton St. NW., Washington, DC (US) 20011

( * ) Notice: Subject to any disclaimer, the term of this patent is extended or adjusted under 35 U.S.C. 154(b) by 862 days.

(21) Appl. No.: 11/624,418

(22) Filed: Jan. 18, 2007

(51) Int. Cl.
*B27B 1/00* (2006.01)

(52) U.S. Cl. ..... 144/278.1; 269/134; 269/139

(58) Field of Classification Search ..... 144/286.1, 144/287; 83/574, 745, 522.25, 471.3, 455, 83/468.3, 597, 383, 471.2; 269/43, 118, 269/134, 139; 182/186.3, 182.2, 182.1, 155.153, 182/181.1
See application file for complete search history.

(56) References Cited

U.S. PATENT DOCUMENTS 2,376,787 A * 5/1945 Larson ..... 182/182.3
2,596,524 A * 5/1952 Bridwell ..... 83/563
2,629,410 A * 2/1953 Cadwell ..... 83/485
2,633,162 A * 3/1953 Neuenschwander ..... 83/522.25
2,677,399 A * 5/1954 Getsinger ..... 83/468.3
2,735,456 A * 2/1956 Grier et al. ..... 83/471.3
2,823,078 A * 2/1958 Keema ..... 182/151
2,926,706 A * 3/1960 Hopla ..... 83/486.1
2,942,633 A * 6/1960 King ..... 83/745
3,368,594 A * 2/1968 Drumbore ..... 83/468.3
3,584,663 A * 6/1971 Yacobucci ..... 30/376
3,741,063 A * 6/1973 Bretthauer ..... 83/745
3,829,231 A * 8/1974 Hamilton ..... 408/108
4,026,222 A 5/1977 Mueller
4,031,794 A * 6/1977 Leihgeber ..... 83/829
4,133,237 A * 1/1979 Lewin ..... 83/468.3
4,215,942 A * 8/1980 Seufert et al. ..... 366/343
4,291,602 A * 9/1981 Fast et al. ..... 83/745
4,335,512 A * 6/1982 Sheps et al. ..... 30/376
4,375,245 A * 3/1983 Schill ..... 182/155
4,427,191 A * 1/1984 Hess ..... 269/43
4,456,043 A * 6/1984 Stocks ..... 144/136.95
4,757,849 A * 7/1988 Morris ..... 144/287
4,782,917 A * 11/1988 Schulz ..... 182/182.2
4,798,113 A * 1/1989 Viazanko ..... 83/471.3
4,877,069 A * 10/1989 Plumley ..... 144/286.1
4,920,845 A * 5/1990 Blanchette ..... 83/574
4,972,748 A * 11/1990 Walsh ..... 83/468.3
5,058,870 A 10/1991 Cetnar
D327,404 S 6/1992 Le Cornec
5,144,994 A * 9/1992 Stecker, Sr. ..... 144/286.5
5,442,984 A * 8/1995 Tate ..... 83/471.2
5,467,972 A 11/1995 Lee et al.
5,473,968 A * 12/1995 Break et al. ..... 83/471.3
5,699,711 A * 12/1997 Gold ..... 83/743
5,865,269 A * 2/1999 Eskesen ..... 182/182.2

(Continued)

*Primary Examiner*—Dana Ross
*Assistant Examiner*—Jennifer Chiang

(57) ABSTRACT

A saw guide system for securing a panel and providing a guide for a saw to cut a straight line across the panel includes a sawhorse being positioned on a support surface. A first rail is coupled to a top plate of the sawhorse. The first rail supports the panel when the panel is positioned on the sawhorse. A support mount is attached to the first rail. A second rail is pivotally coupled to the first rail by the support mount. The second rail is vertically spaced from the first rail to allow the panel to be placed on the first rail. The second rail is pivoted towards the first rail to position the panel between the second rail and the first rail. The second rail is abutted by a saw to maintain a straight cut across the panel when the saw is used to cut the panel.

20 Claims, 5 Drawing Sheets

U.S. PATENT DOCUMENTS 6,050,559 A 4/2000 de Souza
6,644,158 B2 * 11/2003 Cleave et al. ..... 83/455
6,823,603 B1 * 11/2004 Tindall ..... 33/471
6,854,495 B2 * 2/2005 Logan ..... 144/286.5
7,100,653 B2 * 9/2006 Lin ..... 144/286.5
2004/0069109 A1 * 4/2004 Sprague ..... 83/581

* cited by examiner

SAW GUIDE SYSTEM

BACKGROUND OF THE INVENTION

1. Field of the Invention

The present invention relates to panel clamps and more particularly pertains to a new panel clamp for securing a panel and providing a guide for a saw to cut a straight line across the panel.

2. Description of the Prior Art

The use of panel clamps is known in the prior art. While these devices fulfill their respective, particular objectives and requirements, the need remains for a system that has certain improved features to provide a guide for a saw so that a panel can be cross cut by the saw in a straight line. Additionally, the system should be capable of having a horizontal angle set to allow the panel to be cross cut at a desired angle.

SUMMARY OF THE INVENTION

The present invention meets the needs presented above by generally comprising a sawhorse being positioned on a support surface. A first rail is coupled to a top plate of the sawhorse. The first rail supports the panel when the panel is positioned on the sawhorse. A support mount is attached to the first rail. A second rail is pivotally coupled to the first rail by the support mount. The second rail is vertically spaced from the first rail to allow the panel to be placed on the first rail. The second rail is pivoted towards the first rail to position the panel between the second rail and the first rail. The second rail is abutted by a saw to maintain a straight cut across the panel when the saw is used to cut the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
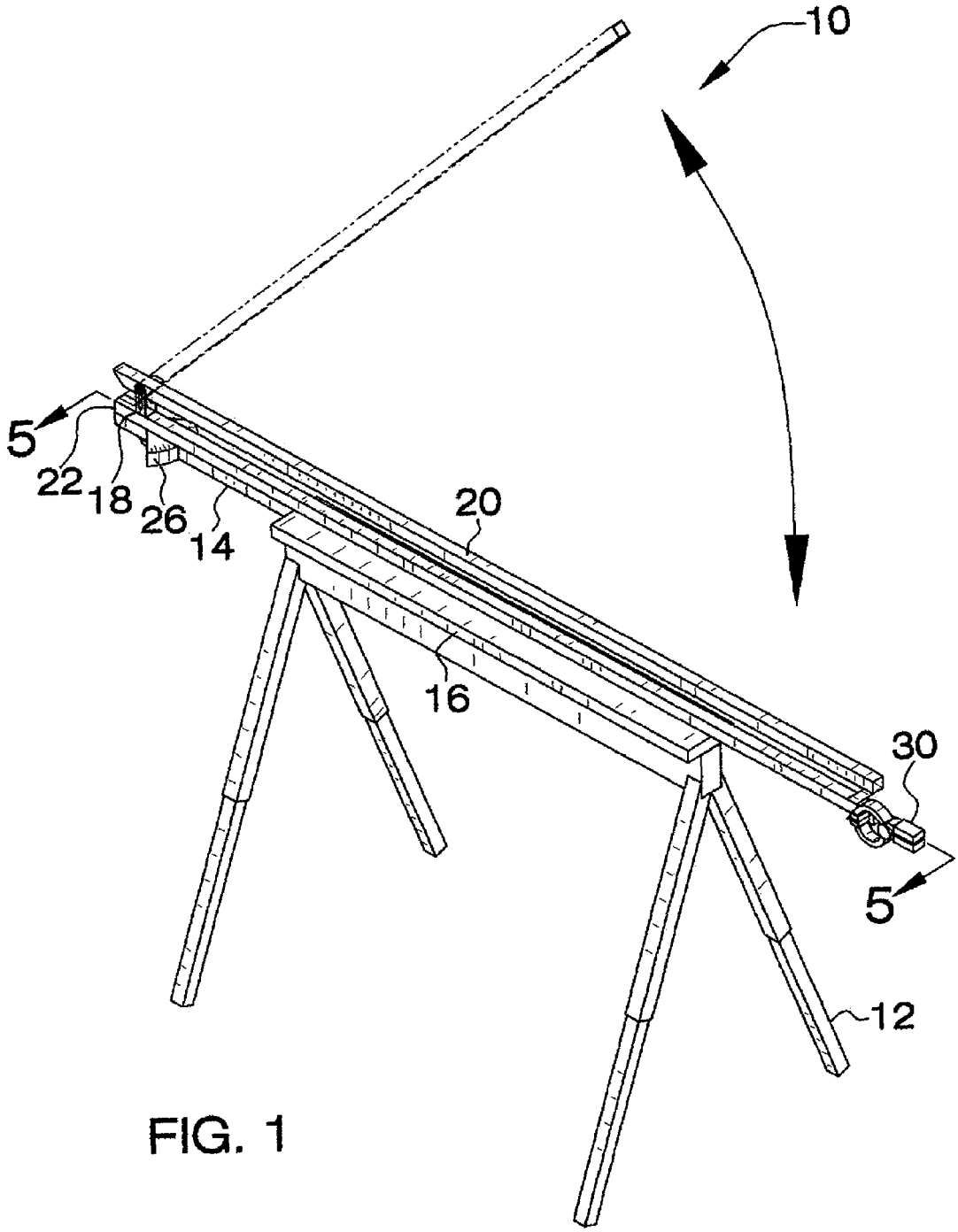
FIG. 1 is a perspective view of a saw guide system according to the present invention.
Figure 2:
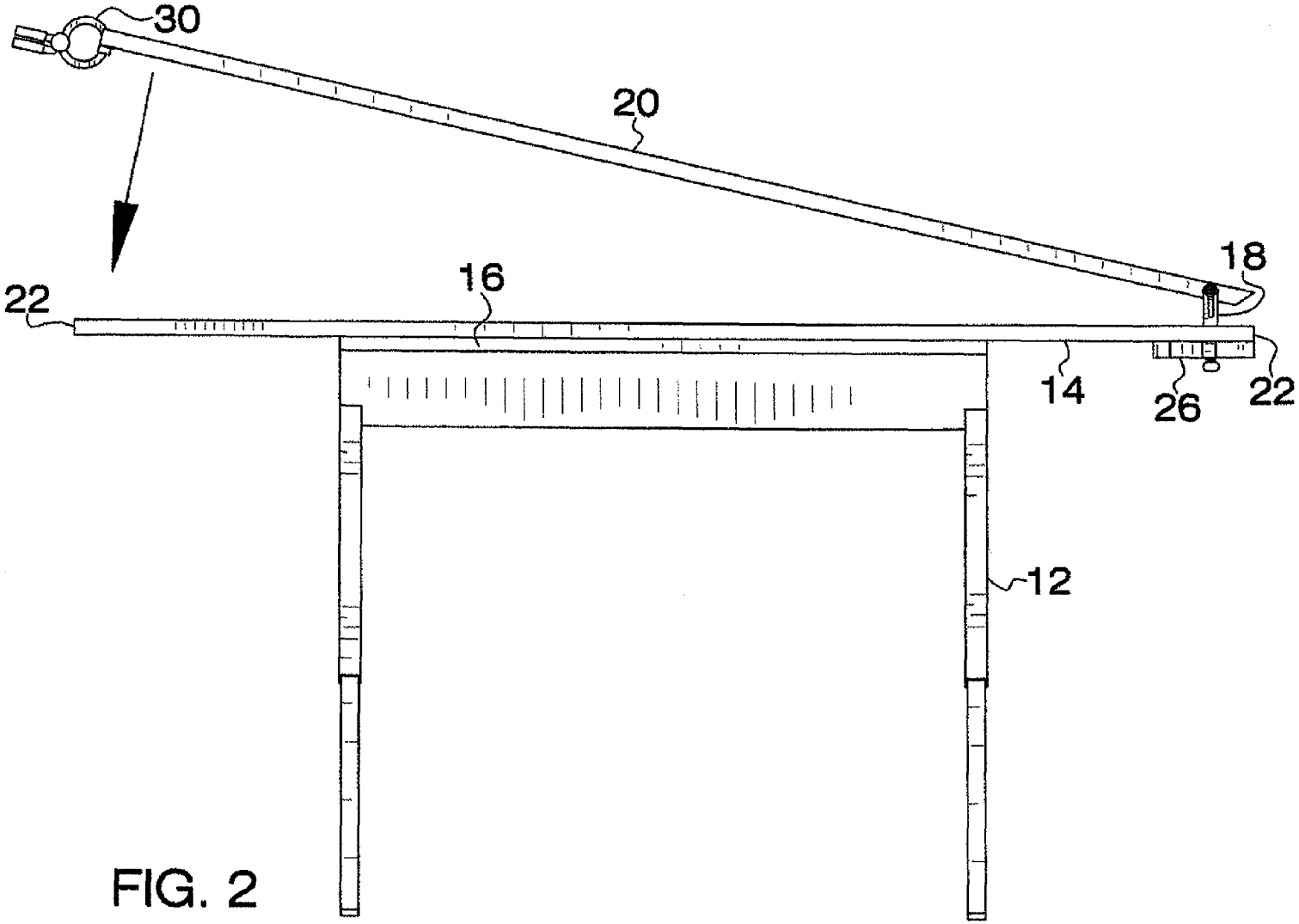
FIG. 2 is a side view of the present invention.
Figure 3:
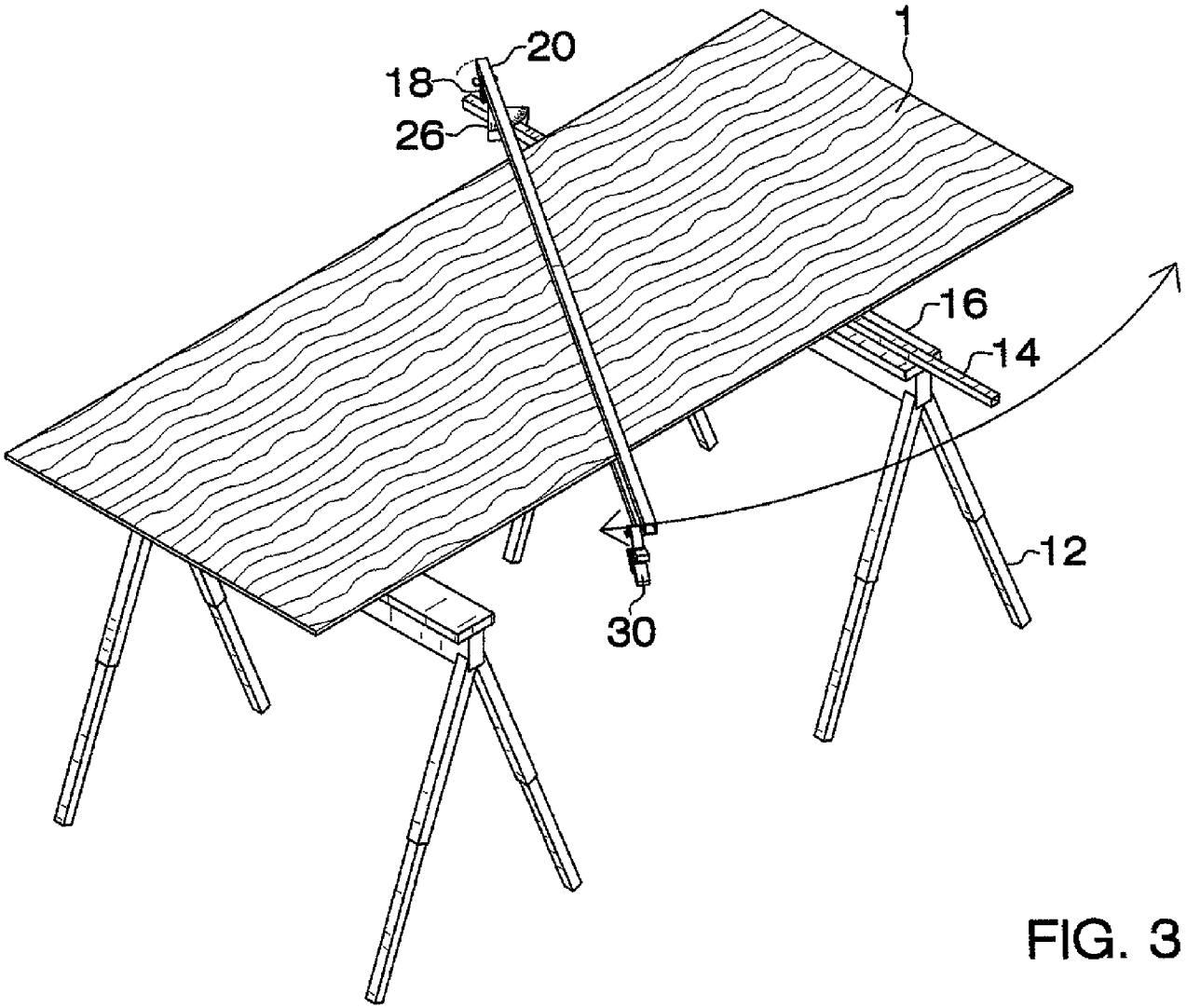
FIG. 3 is a perspective view of the present invention shown in use with a panel.
Figure 4:
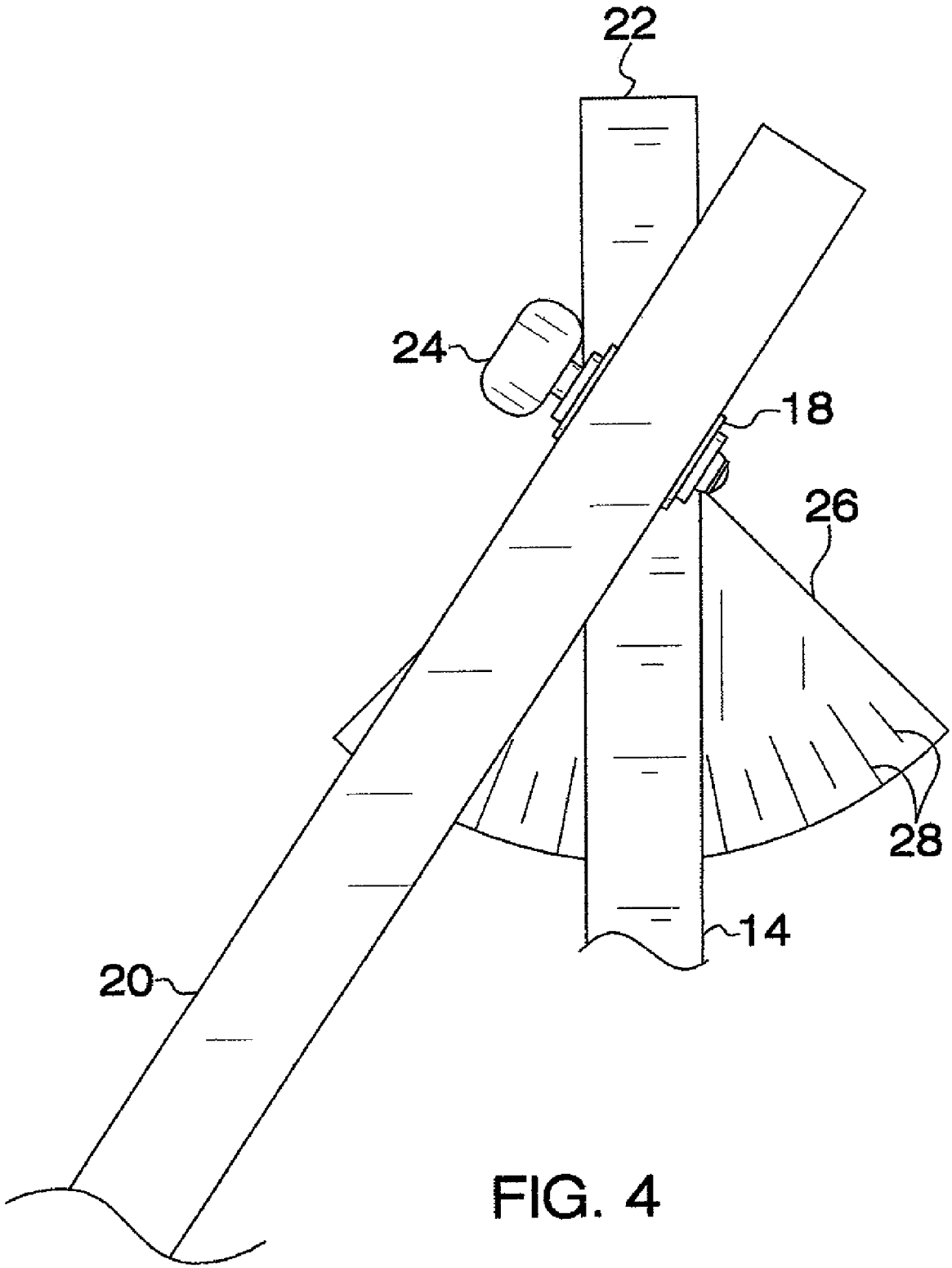
FIG. 4 is an enlarged top view of the gauge of the present invention.
Figure 5:
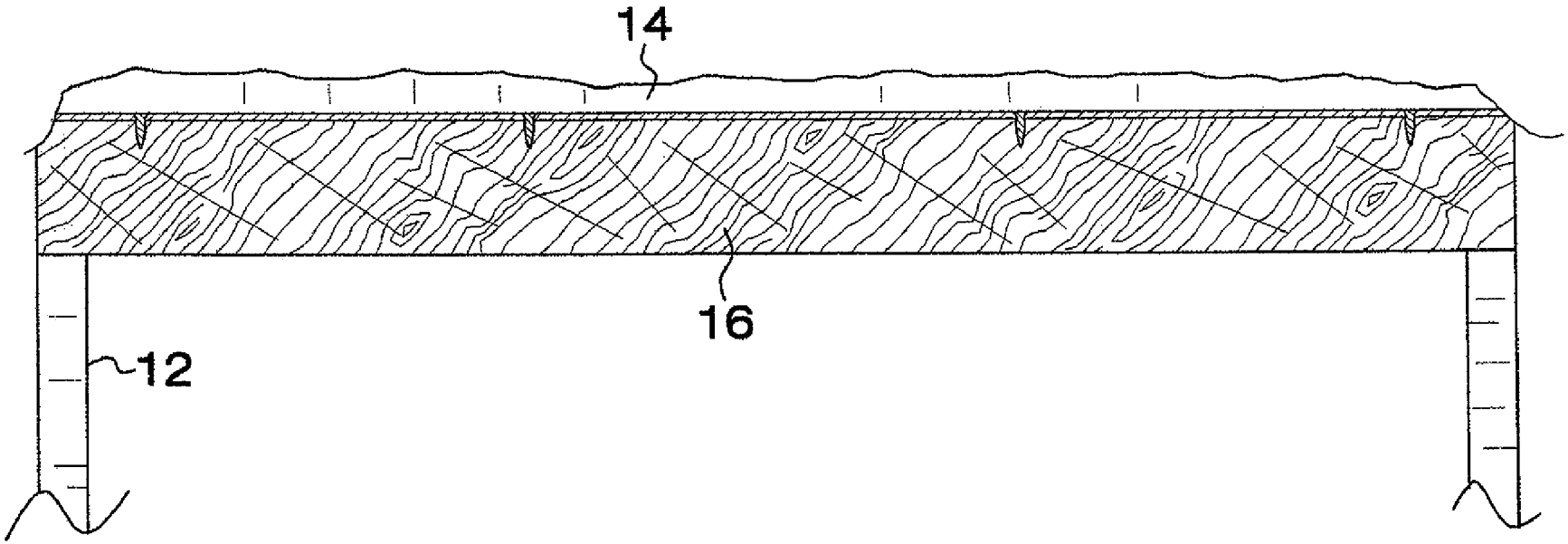
FIG. 5 is a cross-sectional view of the present invention taken along line 5-5 of FIG. 1.

With reference now to the drawings, and in particular to FIGS. 1 through 5 thereof, a new panel clamp embodying the principles and concepts of the present invention and generally designated by the reference numeral 10 will be described.

As best illustrated in FIGS. 1 through 5, the saw guide system 10 generally comprises a sawhorse 12 being positioned on a support surface. The sawhorse 12 has a height between approximately 30 inches and approximately 36 inches. A first rail 14 is coupled to a top plate 16 of the sawhorse 12. The first rail 14 supports a panel 1 when the panel 1 is positioned on the sawhorse 12. The first rail 14 is elongated and has a length greater than a length of the sawhorse 12. A support mount 18 is attached to the first rail 14.

A second rail 20 is pivotally coupled to the first rail 14 by the support mount 18. The second rail 20 is vertically spaced from the first rail 14 to allow the panel 1 to be placed on the first rail 14. The second rail 20 is pivoted towards the first rail 14 to position the panel 1 between the second rail 20 and the first rail 14. The second rail 20 is abutted by a saw to maintain a straight cut across the panel 1 when the saw is used to cut the panel 1. The second rail 20 and the first rail 14 each have a length of approximately 55 inches.

The support mount 18 is rotatably coupled to the first rail 14 adjacent one of a pair of opposing ends 22 of the first rail 14. A fastener 24 secures the second rail 20 to the support mount 18. A height of the fastener 24 with respect to the first rail 14 is adjustable to permit selective adjustment of a distance between the first rail 14 and the second rail 20 to accommodate panels 1 of varying thicknesses. The support mount 18 is rotated with respected to the first rail 14 to permit a horizontal angle of the second rail 20 with respect to the first rail 14 to be adjusted. The support mount 18 is substantially U-shaped.

A gauge 26 is coupled to the first rail 14 adjacent the support mount 18. The gauge 26 includes a plurality of indicia 28 to indicate the horizontal angle of the second rail 20 with respect to the first rail 14. At least one clamp 30 is clamped to the second rail 20 and the panel 1 to secure the second rail 20 in the desired position extending across the panel 1.

In use, the second rail 20 is pivoted away from the first rail 14 and the panel 1 is placed on the first rail 14. The second rail 20 is pivoted towards the first rail 14 to position the panel 1 between the second rail 20 and the first rail 14. The horizontal angle of the second rail 20 with respect to the first rail 14 is set to the desired angle. The at least one clamp 30 is clamped on the second rail 20 and the panel 1 to secure the second rail 20 to the panel 1. The saw is then abutted against the second rail 20 which is used to guide the saw in a straight line when the panel 1 is being cross cut.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A saw guide system for cutting a panel, said system comprising:

a sawhorse being positioned on a support surface, said sawhorse including a plurality of legs and an elongated top plate extending between said legs;

a first rail being coupled to said top plate of said sawhorse, said first rail being positioned directly above said top plate, said first rail extending along a length of said top plate such that a longitudinal axis of said top plate is orientated parallel to a longitudinal axis of said first rail, said first rail supporting the panel when the panel is positioned on said sawhorse;

a support mount being attached to said first rail; and a second rail being vertically and laterally pivotally coupled to said first rail by said support mount, said second rail being vertically spaced from said first rail to allow the panel to be placed on said first rail, said second rail being vertically pivoted towards said first rail to position the panel between said second rail and said first rail, said second rail being abutted by a saw to maintain a straight cut across the panel when the saw is used to cut the panel, an angle between said second rail and said first rail being adjustable as said second rail is laterally pivoted with respect to said first rail.

2. The system according to claim 1, wherein said first rail is elongated and has a length greater than a length of said sawhorse.

3. The system according to claim 1, further comprising a fastener securing said second rail to said support mount, a height of said fastener with respect to said first rail being adjustable to permit selective adjustment of a distance between said first rail and said second rail to accommodate panels of varying thicknesses.

4. The system according to claim 1, wherein said support mount is rotatably coupled to said first rail adjacent one of a pair of opposing ends of said first rail, said support mount being rotated with respected to said first rail to permit a horizontal angle of said second rail with respect to said first rail to be adjusted.

5. The system according to claim 4, wherein said support mount is substantially U-shaped.

6. The system according to claim 4, further comprising a gauge being coupled to said first rail adjacent said support mount, said gauge including a plurality of indicia to indicate the horizontal angle of said second rail with respect to said first rail.

7. The system according to claim 1, further comprising at least one clamp being clamped to said second rail and the panel to secure said second rail in the desired position extending across the panel.

8. A saw guide system for cutting a panel, said system comprising:

a sawhorse being positioned on a support surface, said sawhorse including a an elongated top plate extending support legs of said sawhorse;

a first rail being coupled to said top plate of said sawhorse, said first rail being positioned directly above said top plate, said first rail extending along a length of said top plate such that a longitudinal axis of said top plate is orientated parallel to a longitudinal axis of said first rail, said first rail supporting the panel when the panel is positioned on said sawhorse, said first rail being elongated and having a length greater than a length of said sawhorse;

a support mount being attached to said first rail;

a second rail being vertically and laterally pivotally coupled to said first rail by said support mount, said second rail being vertically spaced from said first rail to allow the panel to be placed on said first rail, said second rail being vertically pivoted towards said first rail to position the panel between said second rail and said first rail, said second rail being abutted by a saw to maintain a straight cut across the panel when the saw is used to cut the panel, an angle between said second rail and said first rail being adjustable as said second rail is laterally pivoted with respect to said first rail;

said support mount being rotatably coupled to said first rail adjacent one of a pair of opposing ends of said first rail, a fastener securing said second rail to said support mount, a height of said fastener with respect to said first rail being adjustable to permit selective adjustment of a distance between said first rail and said second rail to accommodate panels of varying thicknesses, said support mount being rotated with respected to said first rail to permit a horizontal angle of said second rail with respect to said first rail to be adjusted, said support mount being substantially U-shaped;

a gauge being coupled to said first rail adjacent said support mount, said gauge including a plurality of indicia to indicate the horizontal angle of said second rail with respect to said first rail; and at least one clamp being clamped to said second rail and the panel to secure said second rail in the desired position extending across the panel.

9. A saw guide system for cutting a panel, said system comprising:

a sawhorse being positioned on a support surface, said sawhorse including a plurality of legs and an elongated top plate extending between said legs;

a first rail being coupled to said top plate of said sawhorse, said first rail being positioned directly above said top plate, said first rail extending along a length of said top plate such that a longitudinal axis of said top plate is orientated parallel to a longitudinal axis of said first rail, said first rail supporting the panel when the panel is positioned on said sawhorse;

a support mount being attached to said first rail; and a second rail being vertically and laterally pivotally coupled to said first rail by said support mount, said second rail being vertically spaced from said first rail to allow the panel to be placed on said first rail, said second rail being vertically pivoted towards said first rail to position the panel between said second rail and said first rail, said second rail defining a cutting area along which a saw cuts the panel when abutted against said second rail, said cutting area being laterally spaced from said first rail to prevent cutting of said first rail with the saw, an angle between said second rail and said first rail being adjustable as said second rail is laterally pivoted with respect to said first rail.

10. The system according to claim 9, wherein said first rail is elongated and has a length greater than a length of said sawhorse.

11. The system according to claim 9, further comprising a fastener securing said second rail to said support mount, a height of said fastener with respect to said first rail being adjustable to permit selective adjustment of a distance between said first rail and said second rail to accommodate panels of varying thicknesses.

12. The system according to claim 9, wherein said support mount is rotatably coupled to said first rail adjacent one of a pair of opposing ends of said first rail, said support mount being rotated with respected to said first rail to permit a horizontal angle of said second rail with respect to said first rail to be adjusted.

13. The system according to claim 12, wherein said support mount is substantially U-shaped.

14. The system according to claim 12, further comprising a gauge being coupled to said first rail adjacent said support mount, said gauge including a plurality of indicia to indicate the horizontal angle of said second rail with respect to said first rail.

15. The system according to claim 9, further comprising at least one clamp being clamped to said second rail and being securable to the panel to secure said second rail in the desired position extending across the panel.

16. The system according to claim 10, further comprising a fastener securing said second rail to said support mount, a height of said fastener with respect to said first rail being adjustable to permit selective adjustment of a distance between said first rail and said second rail to accommodate panels of varying thicknesses.

17. The system according to claim 16, wherein said support mount is rotatably coupled to said first rail adjacent one of a pair of opposing ends of said first rail, said support mount being rotated with respected to said first rail to permit a horizontal angle of said second rail with respect to said first rail to be adjusted.

18. The system according to claim 17, wherein said support mount is substantially U-shaped.

19. The system according to claim 18, further comprising a gauge being coupled to said first rail adjacent said support mount, said gauge including a plurality of indicia to indicate the horizontal angle of said second rail with respect to said first rail.

20. The system according to claim 19, further comprising at least one clamp being clamped to said second rail and being securable to the panel to secure said second rail in the desired position extending across the panel.

* * * * *